United States Patent [19]

Bailey

[11] Patent Number: 4,863,041

[45] Date of Patent: Sep. 5, 1989

[54] OPTICAL SORTING APPARATUS

[76] Inventor: Roger F. Bailey, P.O. Box 444, Echuca, Victoria, Australia, 3625

[21] Appl. No.: 923,738

[22] Filed: Oct. 28, 1986

[30] Foreign Application Priority Data

Oct. 29, 1985 [AU] Australia ..... PH3159

[51] Int. Cl.[4] ..... B07C 5/342

[52] U.S. Cl. ..... 209/580; 209/585; 209/587; 250/226; 356/425; 356/407

[58] Field of Search ..... 209/576, 577, 580–582, 209/585, 587; 250/226; 356/405, 407, 416, 425

[56] References Cited

U.S. PATENT DOCUMENTS

| | | | |
|---|---|---|---|
| 3,709,612 | 1/1973 | Clemens | 356/425 X |
| 3,993,899 | 11/1976 | Chapman | 209/580 X |
| 4,131,367 | 12/1978 | French et al. | 356/425 X |
| 4,186,838 | 2/1980 | Levitt et al. | 209/581 |
| 4,454,029 | 6/1984 | Codding | 209/581 |
| 4,513,868 | 4/1985 | Culling et al. | 209/576 X |
| 4,699,273 | 10/1987 | Suggi-Liverani | 209/580 |

FOREIGN PATENT DOCUMENTS

| | | | |
|---|---|---|---|
| 0109686 | 5/1984 | European Pat. Off. | 209/580 |
| 0484903 | 1/1976 | U.S.S.R. | 209/580 |
| 2136957 | 9/1984 | United Kingdom | 209/580 |
| 2142426 | 1/1985 | United Kingdom | 209/577 |

*Primary Examiner*—Robert B. Reeves
*Assistant Examiner*—Edward M. Wacyra

[57] ABSTRACT

Optical sorting apparatus for sorting individual objects such as beans, nuts, seeds, or other agricultural products is disclosed. The sorting apparatus according to the present invention detects light reflected from objects and compares the detected light to light reflected from a dynamically variable background. The background is located behind the stream of objects flowing past the light detecting portion of the sorting apparatus. The apparatus is further characterized in that the background is dynamically variable to provide an adjustable reference for the light detecting apparatus. A method for sorting objects by the unique optical apparatus according to the present invention is also disclosed.

3 Claims, 1 Drawing Sheet

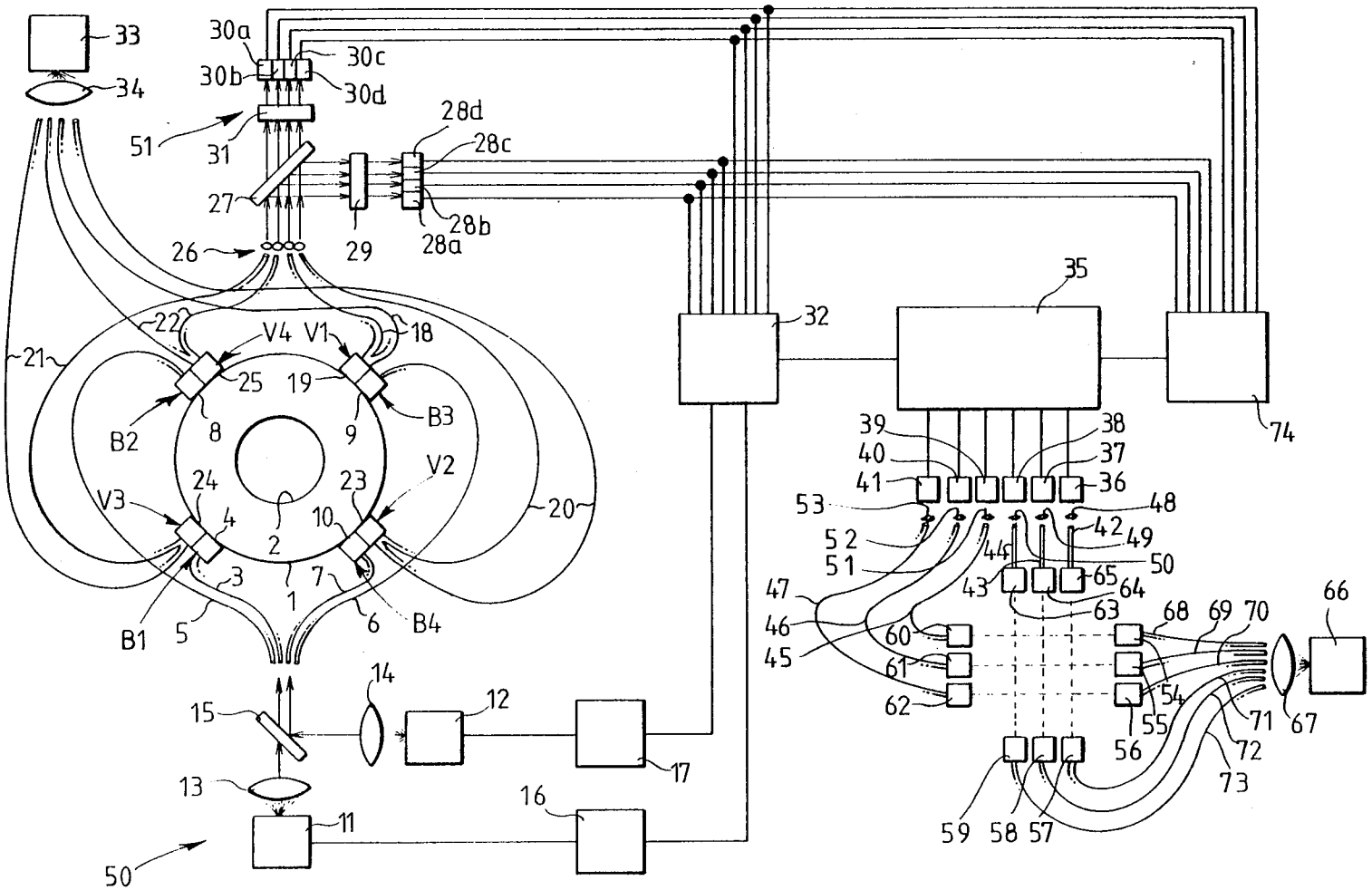
74
35
32
66
67
70
69
68
71
72
73
54
55
56
57
58
59
48
49
50
64
65
63
42
38
37
36
44
43
39
40
41
53
52
51
60
61
62
47
46
45
17
16
12
14
11
15
13
50
20
28c
28d
28b
28a
29
18
B3
V2
B4
6
9
23
10
7
1
2
19
V1
V4
25
8
24
4
3
5
30c
30d
30a
30b
31
27
26
22
B2
V3
B1
51
33
34
21

OPTICAL SORTING APPARATUS

The present invention relates to optical sorting apparatus for sorting individual objects such as beans, nuts, seeds and other agricultural products.

Apparatus of the above kind is adapted to receive a plurality of objects to be sorted. The apparatus generally includes a viewing zone or viewing head for analysing objects inter alia on the basis of colour and/or brightness. The products are delivered individually to the viewing zone or head for optical analysis. The apparatus includes means for rejecting or diverting products which do not meet predetermined analysis criteria.

There presently exist various systems for carrying out optical sorting. These systems are similar in that they include a feeding zone which separates the products into individual streams. The individual streams pass into respective viewing zones where they are illuminated and the reflected light is collected by one or more viewing assemblies and associated detectors.

Where analysis is based on colour at least two detectors are typically provided. Each detector is made responsive to a different part in the light frequency spectrum. The detectors produce electrical signals which are related to the light which they detect. The electrical signals are processed via an electronic circuit which then determines whether a given product falls within an acceptable range. The electronic circuit may activate a rejection mechanism in the event that an object falls outside of an acceptable range. However, a number of problems and disadvantages exist with presently existing sorting apparatus of the above kind, including the following.

Current viewing heads use painted backgrounds as colour references or standards. The color references are critical requiring colour compatibility within 1–1.5% of an acceptable colour range. The backgrounds must be replaced for each colour change. In some apparatus these backgrounds may be changed remotely. Nevertheless, most apparatus requires a large number of backgrounds to be kept. To change from one product to another, e.g. peanuts to coffee beans, requires replacement of two filters and one background for each light detector. There may be up to nine or more light detectors in any given apparatus. Even a change from one grade of coffee bean to another grade usually requires a change of backgrounds. Sometimes the light frequencies are unique and must be determined in a laboratory. Dust and colour deterioration of the backgrounds also give rise to problems.

Current viewing heads use a number of spaced viewing assemblies surrounding the travel stream of products to be sorted. The viewing assemblies are typically located in a single plane perpendicular to the line of travel of the products. This ensures that each viewing assembly views the products at the same time.

Odd numbers of viewing assemblies (3, 5, 7, 9) predominate because each viewing assembly is located opposite an associated background or reference. However, such coplanar arrangements of viewing assemblies give rise to blind spots particularly in regions close to the streams of the products.

Prior art viewing heads are relatively bulky for the viewing area they provide, e.g. 30 cm outside diameter for a 5 cm product viewing area. This is due to the need to accomodate several illuminating lamps (incandescent or fluorescent), spherical lenses having relatively long image and source focal lengths and a plurality of viewing assemblies, photo-detectors, filters etc., and associated reference backgrounds. The lamps generate heat which affect response characteristics of the photo-detectors. Heat also accelerates the abovementioned color deterioration of backgrounds. Cooling is desirable to alleviate color deterioration and avoid drifting of photocell detectors from their cool response characteristics. Prior art viewing heads are deliberately made larger to assist cooling. One disadvantage of bulky viewing heads is that it limits the number of processing channels which a machine of a given size can simultaneously handle. Also because photo-detectors in the viewing head send relatively small currents to processing circuits via long cables these long cables give rise to electrical interference. Electrical interference may be from external sources and from cables carrying relatively high currents to the lamps (due inter alia to capacitance effects).

Existing apparatus generally use different detectors for each viewing assembly. This gives rise to a response imbalance between the detectors because in practice every detecting filter has different characteristics.

Prior art viewing assemblies generally utilize common geometry spherical lenses to focus an image of the product onto respective photo-detectors. This requires a lens which is larger in diameter than the area to be viewed. It also requires the image and source focal lengths to be long. Divergent and convergent beam angles also give rise to timing errors in the rejecting mechanism due to beam width increasing with distance from the focal points, (particularly when defects occur on the heal or toe of a product) sometimes causing good products to be rejected. Additionally, lenses are dependant upon and must be selected according to diameter of the viewing area (i.e. approximate size of product) and focal length.

The problem of rejection of good products is compounded because existing sorting apparatus does not register acceptable products, i.e. it cannot distinguish a good product from no product. The rejecting mechanism ideally should be able to cope with defects located at the heel or toe of a product. However, random location of defects causes some good products to be rejected when a good product is conveyed too close to a defect on another product. This problem is particularly apparent if a product has defects at both ends (i.e. the middle portion is good) causing the apparatus to register two defective products.

Precise alignment of prior art viewing heads and assemblies is required to obtain correct operation. Alignment is generally done in two stages. Firstly, the viewing head is aligned with respect to the product stream. This may need to be done on a regular basis particularly where the apparatus is used to sort a wide range of products. Secondly, each viewing assembly is separately adjusted with respect to the viewing head and product stream. The viewing assemblies ideally are adjusted to form a flat circle around the product stream. This ensures that all views are synchronized in time. If a defect is detected then the rejecting mechanism will be actuated substantially at the same time irrespective of which viewing assembly 'saw' the defect.

It is an object of the present invention to at least alleviate the above-mentioned disadvantages of the prior art. The present invention provides apparatus of the aforementioned kind and incorporates developments which involve a significant departure from currently existing technology.

According to the present invention there is provided optical sorting apparatus for sorting objects moving in a stream, said apparatus comprising:

means for detecting light from said objects;

background means locatable behind said stream relative to said detecting means, wherein said background means is dynamically variable to provide an adjustable reference for said detecting means. This is in contrast to the passive or fixed backgrounds of the prior art.

According to a further aspect of the present invention there is provided a method of sorting objects moving in a stream by optical means, said method comprising the steps of:

providing means for detecting light from said objects;

providing background means behind said stream relative to said detecting means, wherein said background means is dynamically variable to provide an adjustable reference for said detecting means.

The apparatus of the present invention may include at least source of light (mono-chromatic) for said background(s). The light source preferably is adjustable in intensity. Multi-chromatic apparatus (e.g. bi-chromatic) may include two or more light sources. Each light source may comprise white light, e.g. a quartz halogen incandescent lamp. Each light source preferably is separately adjustable in intensity. The intensity of the or each light source may be adjustable by any suitable means. In one form, the or each light source may be adjustable via a respective 'dimmer' control circuit. Each dimmer circuit may include at least one solid state switching element such as a thyristor. The dimmer control circuits may be constructed in any suitable manner as is known in the art. Alternatively intensity of the light source may be adjustable by means of polarizing filters or other means which reduces intensity of light.

Bi-chromatic apparatus preferably includes means adapted to provide a pair of light sources having substantially mutualy exclusive spectral content. The light spectrum may be split at any frequency which falls between the light frequencies of interest. For example, where the light frequencies of interest are say, 530 nm and 660 nm respectively, the light spectrum may be split at say, 650 nm. One light source may be adapted to provide spectral content below 650 nm (green). The other light source may be adapted to provide spectral content above 650 nm (red). The apparatus preferably includes filter means. The filter means may be adapted to pass light having specific spectral content. The filter means may include a first filter adapted to pass a first component of light, the spectral content of which is centered at 530 nm. The filter means may include a second filter adapted to pass a second component of light, the spectral content of which is centered at 660 nm.

The light sources may be combined to provide a composite beam of light. The light sources may be combined in any suitable manner. In one form, the light sources may be combined by means of a half silvered mirror. The light sources to be combined preferably are oriented in paths substantially 45° to the plane of the half-silvered mirror and at right angles to each other.

It will be appreciated that by independently adjusting the intensities of the light sources, e.g. by adjusting the voltage to each lamp, a desired mix of light content above and below 650 nm may be achieved.

According to a preferred embodiment of the present invention, the filter function and combining function may be provided in a single device such as a dichroic mirror. A dichroic mirror transmits light above a given threshold frequency and reflects light below the threshold frequency. The dichroic mirror may be chosen to split light at a desired frequency, e.g. 650 nm.

According to a further embodiment each white light source and filter may be replaced by a substantially mono-chromatic light source such as an L.E.D. array. The L.E.D. array may be selected to provide an output having any convenient frequency of light (color). These may be selected to be similar to filters associated with the detecting means.

Mixing also may be performed by means of optic fibres. For example, a bundle of optic fibres may be formed into a cable which is befurcated at one end. The cable may be formed such that alternate fibres in the bundle are accessed by one light source whilst the remaining fibres are accessed by the other light source. This increases the cost of the optic cables but eliminates the need for a dichroic mirror to combine the two light sources.

According to the present invention, the light sources preferably are located remote from the viewing head. Light may be conducted from the sources to the viewing area via one or more suitable conduits such as optic fibres. The optic fibres may comprise glass or plastics. The optic fibres may be formed into bundles or cables having any suitable length and cross section. Preferably, the bundles are rectangular in cross section at least in the region of the viewing area. Rectangular bundles are preferred because it has been found that they minimize occurrence of blind spots when compared to circular bundles.

Each active background for the sorting apparatus of the present invention may be provided by an optic cable comprising one or more optic fibres. One terminal end of the optic cable may define each background surface. The relative spectral content of light being conducted along the optic cables may be dynamically adjusted by means of the abovementioned dimmer circuits thereby adjusting the spectral content of the reference backgrounds. The above arrangement lends itself readily to automatic control. Relative spectral content of the backgrounds may be adjusted automatically by adjusting the dimmer circuits. This may be done via a suitable electronic circuit.

The detecting means of the present invention may include at least one photo-detector such as a photo-cell. The or each photo-detector preferably is located remotely from the viewing head of the apparatus.

Remote location of detectors (and light sources) is desirable because it minimizes interference. This is so because respective electrical connecting leads may be kept as short as possible and separate from each other. Thus photo-detectors may be placed adjacent their respective processing circuits and light sources may be located adjacent their power supply to minimize cable length.

The detecting means may receive light from the objects being sorted via suitable conduits such as optic fibres. The optic fibres associated with the detecting means may be formed into cables having any suitable cross section. Preferably, the detecting cables are rectangular in cross section at least in the region of the viewing area. Rectangular cables are preferred because they minimize occurrence of blind spots and assist a scanning action as an object moves through the viewing area of the detecting means. In one form, the detecting cables may comprise a bundle of fibres substantially 2 mm high and 13 mm wide in cross section. The dimensions of each bundle of optic fibres may be increased or decreased as required. The light receiving end of each cable of optic fibres preferably is directed at a background located opposite. The light receiving ends of the optic fibres may be focussed in any suitable manner such as my means of lenses.

Focussing may be performed by means of micro lenses. Micro lenses manufactured by *Nippon Sheet Glass* and sold under the trade mark "Selfoc" may be used. Micro lenses are more compact than conventional lenses having similar focal length. A typical micro lens may be 4 mm long and 1.8 mm in diameter. Micro lenses perform the same function as standard spherical lenses with the added feature that the end surfaces are flat. Micro lenses sold under the trade mark "Selfoc" exhibit an index of refraction which varies parabolically across its surface with radial distance from its axis.

The micro lenses may be arranged in arrays. Each array may comprise a stack of micro lenses. The stacks preferably are sufficiently high and wide to cover the area of an associated optic fibre bundle. The micro lenses may be staggered in the array like 'bricks' to minimize occurrence of blind spots.

One micro lens array may be placed adjacent the light collecting end face of each bundle of optic fibres. The micro lenses preferably are spaced from the end faces such that they focus at infinity. In one form, each micro lens may be spaced just 0.2 mm from an associated end face.

The detecting means may include a beam splitter such as a half silvered mirror. The beam splitter may be adapted to separate light received from the detecting cables into two beams. The two beams may be passed through separate detecting filters to respective photocell detectors. The detecting filters preferably pass only selected light frequencies. For example, one filter may be adapted to pass a narrow band of light frequencies centered at 530 nm. The other filter may be adapted to pass a narrow band of frequencies centered at 660 nm.

The photo-cell detectors may be adapted to produce electric signals which are related to the amount of light they receive. A suitable electronic circuit may be associated with the photo-cell detectors to provide an output signal indicative of the relative content of the two bands of frequencies, (i.e. 660 nm:530 nm in the example given) present in the light which is detected.

A plurality of backgrounds and associated detectors may be used to surround the product viewing area. Each detector is adapted to receive light from the oppositely located background.

When dealing with relatively large or small objects, more or fewer backgrounds and detectors may be employed. For example with five backgrounds and detectors, the backgrounds may be located substantially 72° apart. In general, sufficient backgrounds and detectors are required to cover substantially the whole of the surface area of the object being sorted.

Where an even number of backgrounds is used the "background" optic cables and "detecting" optic cables may be produced as integrated assemblies. Each integrated assembly may include one bundle of "background" optic fibres and one bundle of "detecting" optic fibres and associated lenses. The integrated assemblies may be fitted to any size viewing head having any even number of view.

According to a preferred embodiment of the present invention all detecting cables of the apparatus may be associated with a common light detecting means. That is the "detector" ends of the bundles of detecting optical fibres maybe brought together so that light from the bundles may pass through a common beam splitter and detecting filters. An advantage of the latter arrangement is that light from each detecting cable may be processed similarly thereby eliminating response differences. Each bundle of detecting optical fibres preferably is terminated with a suitable lens such as plano convex lens. The plano convex lenses may be adapted to collimate the beams to enable them to pass through the same beam splitter and detecting filters.

The apparatus of the present invention includes object sensing means. The sensing means may be adapted to sense presence and/or location of an object relative to the viewing head. The sensing means may include one or more sensing beams. The sensing beams preferably comprise electrogmagnetic energy such as infra-red. The sensing beams preferably are located in the object viewing zone such that they cross the object stream. The sensing beams preferably cross the object stream substantially at right angles thereto.

In one form, the sensing means may comprise at least one infra-red generator and associated receiver. The or each infra-red generator and associated receiver preferably are located remote from the viewing zone. Infra-red beams may be conveyed to and from the viewing zone via suitable conduits such as optic fibres. Transmitting fibres may be used to convey infra-red sensing beams from the or each infra-red generator to the viewing zone. Receiving fibres may be used to convey the sensing beams from the viewing zone to the (or each) associated infra-red receiver. The receiving and transmitting fibres may be located on opposite sides of the object stream. The transmitting and receiving fibres preferably are located such that the or each infra-red beam crosses the object path substantially at right angles thereto. The or each infra-red beam may be adapted to intercept objects passing through the viewing area.

The object sensing means may comprise a plurality of infra-red beams. In one form, six beams may be used. The six beams preferably are substantially coplanar. The six beams may be arranged in two sets of three beams each. The beams of one set may be perpendicular to the beams of the other set. The three beams of each set preferably are parallel and equally spaced.

Signals from the receivers of all six beams may be applied to logic means such as an OR gate. The output of the OR gate will switch if one or more of the beams is intercepted by an object. The infra-red beams preferably are located so that the intersection of the middle of each set of three beams lies substantially along the line of travel of the objects.

The object sensing means may be adapted to provide accurate timing control to the rejecting mechanism. In one form, the object sensing means may be adapted to generate an enable pulse having a predetermined dwell time, to the rejecting mechanism. Dwell time of the enable pulse also may be controlled by the object sensing means. The enable pulse may enable the rejecting mechanism for the duration of the enable pulse. It will be appreciated that larger objects will intercept the sensing beam(s) for longer periods. Accordingly, the enable pulse dwell time may be dependent on object size (traversing length).

Because timing information may be provided to the rejecting mechanism by the object sensing means, the various backgrounds and associated detectors do not have to be synchronized. Hence the "viewing assemblies" (backgrounds and associated detecting cables) do not have to be in a common plane but may be placed at oblique angles to the object stream. This reduces the number of blind spots on the object. It also enables more viewing assemblies to be placed into a given space.

The object sensing means may be used inter alia for alignment purposes. As previously noted, the viewing head should be aligned accurately for optimum results. Prior art alignment procedures rely on physical sighting of the product sensing means may be used to align the viewing head relative to the object stream.

The sensing beams described above may be used to determine which beams are being intercepted by the stream of objects. The outputs of the receivers of the beams may be processed by a suitable electronic circuit to determine which beam or beams are being intercepted with most frequency.

The viewing head may be adjusted until only the middle beams of each set are intercepted by the object stream. This would indicate that the object stream is in the centre of the viewing zone. Any number of beams may be used, for example 4 or 5 beams for each set, particularly where variation in product size is relatively large.

The apparatus according to the present invention may not require alignment of individual viewing assemblies. The actual position of the detecting cables and lenses may be made dependent on the original machining of the viewing head and hence may not alter significantly in use. Because lenses are focussed at infinity focussing of lenses may be obviated when changing from one product size to another. Furthermore, because individual detecting cables may transmit light into a common beam splitter and detecting filters, inaccuracies in this section of the apparatus affect all viewing assemblies in the same way.

The apparatus of the present invention preferably includes product illumination means. The illumination means preferably is arranged such that reflected and stray light within the object viewing zone is kept to a minimum. Illumination of an object preferably is limited to an area which is substantially the same as the viewed area of the object. The illuminating light may be directed into the viewing area in a substantially rectangular format.

Illuminating light may be provided in any suitable manner and by any suitable means. In one form illuminating light may be provided from a remote light source and conveyed to the viewing zone. Light preferably is conveyed to the viewing zone by means of one or more optic fibres. The optic fibres may be formed into bundles or cables as previously described. Illuminating light may also be conveyed to the object viewing zone by means of lens arrays, lenses, mirrors etc.

It is preferable to illuminate only that portion of an object which is scanned by the detecting means. In other words the illuminated area and the viewing area of the detecting means preferably correspond on the product. The illuminated area preferably comprises a rectangle with its long edge across the product stream. Other patterns of illumination could be used eg. circular.

In one form the receiving end of the optic cable associated with the detecting means and the transmitting end of the cable associated with the illumination means may be arranged side by side. The cables may be arranged such that the illuminated area and detecting means viewing area coincide substantially on the product.

A still better result may be obtained by randomly inter-mixing the receiving ends of the detecting optical fibres and the transmitting ends of the illuminating fibres to form a combined illuminating/detecting cable. The opposite end of the combined illuminating/detecting cable is bifurcated with the illuminating fibres being directed to the illuminating light source and the detecting fibres to their respective photo-detector. Reflection from lenses associated with the illuminating/detecting cable may be reduced by applying anti-reflecting coatings to the lenses.

The present invention preferably includes means for automatically setting the backgrounds. The background setting means may be provided in any suitable manner. The background setting means may include means for comparing the output from the detecting means when a good product is in view with the output from the detecting means when no product is in view, i.e. when the detecting means only sees the backgrounds.

The background setting means may include means for adjusting the intensity of light sources which provide light to the optical cables which make up the backgrounds. The light sources for each channel (i.e. above 650 nm and below 650 nm in the example given) may be adjusted separately. The intensity of the lamps preferably are adjusted so that the output of the comparing means is a minimum. In other words, the backgrounds are compared to a good product and adjusted such that their spectral content (at least in the critical area) is substantially the same as that of the good product. This is in contrast to prior art apparatus in which backgrounds are selected from fixed standards and products are compared to the standards.

BRIEF DESCRIPTION OF THE DRAWING

The sole drawing of the application is a schematic representation of one preferred embodiment according the present invention.

DETAILED DESCRIPTION OF THE PREFERRED EMBODIMENTS

A preferred embodiment of the present invention will now be described with reference to the accompanying drawing.

The apparatus shown in the drawing includes a viewing head 1. The viewing head 1 surrounds an object viewing zone 2. Objects to be viewed move through the viewing zone 2 in a direction substantially perpendicular to the page. Mounted around the viewing head 1 is a plurality of background assemblies B1–B4 and a corresponding plurality of viewing assemblies V1–V4. Viewing assemblies V1–V4 are located opposite respective background assemblies B1–B4.

Background assembly B1 includes an optic cable 3 and lens array 4. Similarly background assemblies B2–B4 include respective optic cables 5, 6, 7 and lens arrays 8, 9, 10. Each cable 3, 5, 6, 7 comprises a plurality of optic fibres.

Backgrounds B1–B4 are supplied with sources of light from the assembly shown generally at 50. The assembly 50 includes light sources 11, 12. Light sources 11, 12 feed into the free ends of optic cables 5, 3, 7, 6 via respective lenses 13, 14 and dichroic mirror 15. Alternatively light sources 11, 12 may be prefocussed obviating lenses 13, 14. Dichroic mirror 15 passes light above 650 nm from light source 11 and light below 650 nm from light source 12. Light sources 11, 12 are controlled via respective dimmer control circuits 16, 17.

Viewing assembly V1 includes a bifurcated optic cable 18 and lens array 19. Similarly viewing assemblies V2–V4 include respective bifurcated optic cables 20, 21, 22 and lens arrays 23, 24, 25. Each cable 20, 21, 22 comprises a plurality of optic fibres.

One free end of each bifurcated optic cable 21, 22, 18, 20 feeds into a detecting arrangement shown generally at 51. Detecting arrangement 51 includes a plurality of lenses 26 and a half-silvered mirror 27. Half-silvered mirror 27 passes light collected from optic cables 21, 22, 18, 20, to respective photo-detectors 28*a*–28*d* via filter 29 and to respective photo-detectors 30*a*–30*d* via filter 31.

Signals from photo-detectors 28*a*–28*d*, 30–30*d* are received by background setting means 32. Background setting means 32 includes amplifier means and comparator means. Background setting means 32 adjusts dimmer control circuits 16, 17 such that when a product of good quality is dropped through viewing zone 2, the differences in signals from photo-detectors 28*a*, 30*a* with product in view/product out of view is a minimum. Background setting means 32 additionally receives signals from object sensing means 35.

The other free end of each optic cable 21, 22, 18, 20 is supplied with a source of illuminating light from wide band light source 33 and lens 34.

Object sensing means 35 processes signals from a plurality of infra-red detectors 36–41. Detectors 36–41 receive infra-red beams via respective optic fibres 42–47 and lenses 48–53.

The product sensing means includes a plurality of transmitting lenses 54–59 and a corresponding plurality of receiving lenses 60–65. Receiving lenses 60–65 and/or lenses 48–53 may be doped with filter material. The filter material may be adapted to transmit infra-red light only thus reducing errors due to stray light etc. Additionally or alternativley infra-red filter material may be placed over infra-red detectors 36–41 for this purpose. Transmitting lenses 54–59 receive infra-red light from infra-red generator 66 via lens 67 and optic fibres 68–73. Lens 67 may be doped to transmit infra-red light only in which case generator 66 may be wide band. Transmitting lenses 54–59 are adapted to send infra-red beams to respective receiving lenses 60–65.

Infra-red transmitting lenses 54–59 and receiving lenses 60–65 although shown separately are located inside viewing head 1. Sensing means 35, infra-red detectors 36–41 and lenses 48–53 are located remote from viewing head 1. The transmitting and receiving lenses are oriented in viewing head 1 such that the infra-red beams are intercepted when a product is being viewed by the viewing assemblies. The intersection of control beams for transmitting lenses 55 and 58 preferably lie substantially along the direction of product flow.

When backgrounds have been set product sensing means 35 enables rejecting means 74 whenever the product rejecting means detects that the components of light received by photo-detectors 28*a*–28*d*, 30*a*–30*d* are not compatible with an acceptable product.

It will be appreciated that the arrangement of the present invention enables backgrounds to be matched quickly to any product even when the background values for the products are unique or unknown.

To change from one product to another, say peanuts to coffee, requires replacement of a total of two filters only for the whole apparatus and does not require replacement of any backgrounds. To change from one coffee bean to another requires no change of parts. The operator merely selects 'adjust nulls' on the apparatus and then drops a good product into the viewing area. The good product is scanned by each viewing assembly and detected by the infra-red beams.

During the nulls adjustment stage light sources 16, 17 are adjusted so that the light components received by photo-detectors 28*a*, 30*a* are the same (or as close as possible) when a product of good quality is in view as when no product is in view.

When light sources 16, 17 have been adjusted the apparatus may indicate to the operator that the backgrounds are set and ready to run. When the apparatus is sorting one type of product only (95% of machines do in practice) the apparatus of the present invention requires no change of parts.

The background adjustment described herein is possible because two controlled light sources are used for independently adjusting the two light frequencies of interest, e.g. 530 nm and 660 nm. This is in contrast to current technology which used a fixed white light from incandescent lamps.

The present invention allows a particularly compact viewing head to be constructed. This allows more processing channels to be included in a sorting apparatus per given floor space. For example, for an 8 cm viewing area the viewing head may be approximately 13–15 cm in outside diameter. Several features of the present invention contribute to the compact dimensions of the viewing head including:

(1) light sources may be located remote from viewing head (2) light detectors may be located remote from viewing head (3) product sensing means may be located remote from viewing head (4) each background and viewing assembly may be combined into one integrated assembly (5) minimum heat generated hence cooling is not required (6) lenses having short focal lengths may be used.

The apparatus of the present invention may be adapted to operate in mono-chromatic or b-chromatic configuration with the same viewing head. This requires one background light source only and one receiving channel, i.e. one light source may be turned off or eliminated.

It will be appreciated that various modifications and/or alterations may be introduced into the constructions and arrangements or parts previously described without departing from the spirit or ambit of the present invention.

I claim:

1. Optical sorting apparatus for sorting objects in an object stream such as agricultural products, said apparatus comprising:

at least one means for detecting light reflected from said objects;

at least one dynamically variable, light emitting, background located opposite, relative to said object stream, each said light detecting means, each said background being dynamically variable to automatically vary both the spectral content and intensity of light emitted from said background;

a first background optic bundle associated with each said background, each said first optic bundle being comprised of a plurality of optic fibers used to transmit light to said background from a first source of light located at a position remote from said background;

a first end of each said first optic bundle, each said first end terminating at a separate background to transmit light to that respective background;

a second end of each said first optic bundle, each said second end terminating at a first source of light in order to conduct light from said source to each separate background, said first light source being capable of varying the intensity of light transmitted to said background;

a second source of light, adapted to transmit light to each said background via a separate second optic bundle of optic fibers;

each said second optic bundle having a first end terminating in a separate background, and a second end terminating at said second light source so that light generated by said second light source is transmitted, via said second optic bundles, to said background;

said second light source being capable of varying the intensity of light transmitted to said background via said second optic bundles; and wherein light from said first and second sources of light is combined through the use of a dichroic mirror.

2. The apparatus according to claim 1 wherein said dichroic mirror transmits light above 650 nm and reflects light below 650 nm.

3. The apparatus according to claim 1 further comprising sensing means to sense the presence of objects in said apparatus; said sensing means in turn comprising a plurality of infra-red beams intercepting said object stream at substantially right angles to the object stream; said beams being oriented so that they intercept said object stream as said detecting means detects light reflected from said objects.

* * * * *